US007448896B2

(12) United States Patent
Malak et al.

(10) Patent No.: US 7,448,896 B2
(45) Date of Patent: Nov. 11, 2008

(54) CONNECTOR RELEASE TAB

(75) Inventors: Stephen P. Malak, Manlius, NY (US); David H. Jackson, Manlius, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 0 days.

(21) Appl. No.: 11/425,768

(22) Filed: Jun. 22, 2006

(65) Prior Publication Data

US 2007/0298646 A1 Dec. 27, 2007

(51) Int. Cl.
*H01R 13/627* (2006.01)

(52) U.S. Cl. ..... 439/352

(58) Field of Classification Search ..... 439/352, 439/344, 676, 822

See application file for complete search history.

(56) References Cited

U.S. PATENT DOCUMENTS 4,832,625 A * 5/1989 Puerner ..... 439/681
5,295,855 A * 3/1994 Walz ..... 439/354
5,641,300 A * 6/1997 Corrion ..... 439/352
6,394,824 B1 * 5/2002 Huang ..... 439/108
6,431,887 B1 * 8/2002 Yeomans et al. ..... 439/108
6,497,585 B2 * 12/2002 Torii ..... 439/352
6,537,099 B2 * 3/2003 Herlinger et al. ..... 439/352
7,101,212 B1 * 9/2006 Larkin ..... 439/344

* cited by examiner

*Primary Examiner*—Truc T Nguyen
(74) *Attorney, Agent, or Firm*—Schmeiser, Olsen & Watts

(57) ABSTRACT

A connector having an improved means of providing contact or locking with the connector comprising a connector body having an input section and an output section, wherein said output section is dimensioned for insertion into a corresponding socket. A connector tab having a locking device, said connector tab having a first end and a second end, wherein the first end is attached to and lies within the input section of the connector body and the second end is spaced away from connector body, wherein said locking device is positioned at the second end, wherein the locking device is within the output section. An enhanced contact pressure connector may comprise at least one raised pressure area, wherein said raised pressure area may be positioned to be within the output section of the connector body on the other side, and further wherein when said raised pressure area directs force to the at least one contact when compressed.

10 Claims, 9 Drawing Sheets

CONNECTOR RELEASE TAB

FIELD OF THE INVENTION

The invention is in the field of electrical connectors and plugs. More particularly, this invention relates to an electrical connector removably lockable within a socket.

BACKGROUND

Communication cables and in particular data cables used for the transmission of information according to the Ethernet standard are commonplace and used in a multitude of environments including commercial offices and buildings, industrial environments, and with increasing frequency, residences.

Commonly used cables often include twisted wire pairs. Furthermore, a data cable may contain two connectors on both ends to connect a computer or network device. A type of cable connector being used with increasing frequency in residences and small businesses is generally referred to as RJ-45 connector, RJ stands for registered jack. They were originally invented and patented by Bell Telephone Laboratories (patent filed 6 Jul. 1973; U.S. Pat. No. 3,860,316 issued 14 Jan. 1975), and replaced the hard-wired connections on most Western Electric telephones around 1976. Thus, they are also sometimes called Western jacks and Western plugs.

However, RJ-type connectors suffer from a few limitations. For example, the common locking tab of a typical RJ-type makes insertion and removal from the terminal jack difficult. Moreover, durability is a problem because of breakage from use and common incidents whereby the tab gets caught or snagged on other cables or foreign objects. Still further, common connectors may suffer from faulty terminal connections. Therefore, there is a need for a cable connector to inter alia, overcome the above mentioned shortcomings.

SUMMARY OF THE INVENTION

A first general aspect of the invention provides a connector comprising a connector body having an input section and an output section, wherein said output section is dimensioned for insertion into a corresponding socket; a connector tab having a locking device, said connector tab having a first end and a second end, wherein the first end is attached to and lies within the input section of the connector body and the second end is spaced away from connector body, wherein said locking device is positioned at the second end, wherein the locking device is within the output section.

A second general aspect of the invention provides a reverse lock-tab connector comprising a connector body having an input end, an output end, a first side and a second side; a connector tab having a base end and a lock end, wherein the base end is attached to the input end of the connector body and wherein the lock end is spaced away from connector body.

A third general aspect of the invention provides an enhanced contact pressure connector comprising a connector body having an output section, an input section and at least two sides, wherein the sides are opposite each other; at least one contact positioned on the connector body in the output section on one side; at least one raised pressure area, wherein said raised pressure area is positioned to be within the output section of the connector body on the other side, wherein when said raised pressure area directs force to the at least one contact when compressed.

A fourth general aspect of the invention provides a connector for improved contact tension within a corresponding socket, said connector comprising a connector body having at least one contact; a means of locking the connector within the corresponding socket, said means of locking positioned on said connector body; at least one means of increasing pressure to the at least one contact when the connector body is inserted into the corresponding socket.

DETAILED DESCRIPTION OF THE INVENTION

Figure 1:
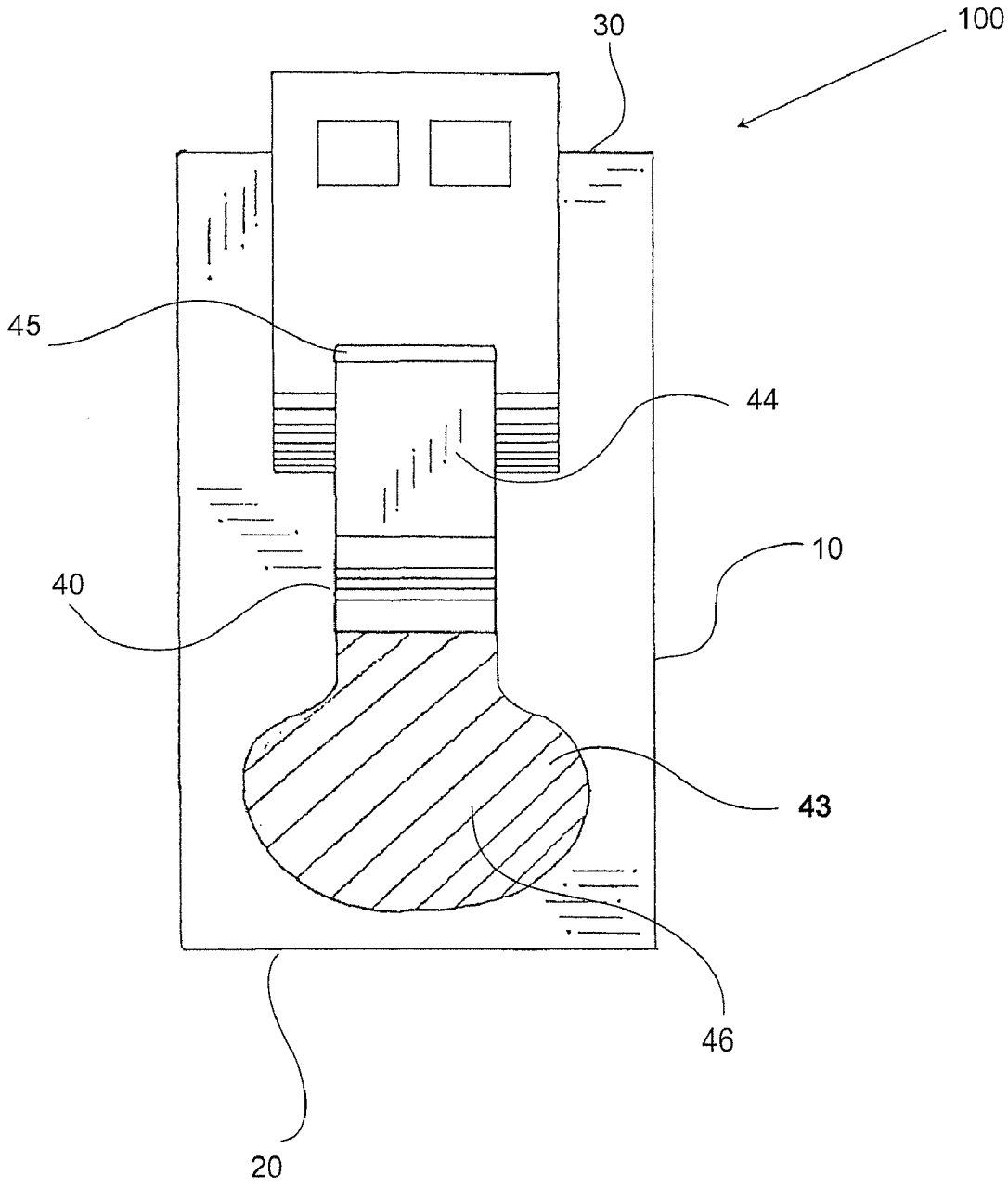
FIG. 1 displays a top view of one embodiment of the connector.

The present invention increases the ease of use of a locking tab of a connector and maintains better terminal contact through additional pressure and a better fit within a terminal jack. Moreover, the invention addresses the shortcomings that may be found on Registered Jacks such as the RJ-45, RJ-11 or any other shaped locking connectors by improving the locking tab on these connectors thereby improving both the quality of the terminal connection and durability of the tab on the connector.

The invention, inter alia, addresses deficiencies found on a standardized jack such as an RJ-11 jack, the jack is a physical interface often used for terminating telephone wires. It typically has six positions with two pins (electrical connections) installed at positions 3 and 4. When designated as an RJ-14, the designation indicates that there is a second pair for an additional line on pins 2 and 5. Designations as RJ-12 or RJ-25 indicate that there is a third pair on pins 1 and 6. These different configurations are all shared within the same connector even if all the electrical positions are not wired.

RJ-XX is a general term for electrical connector designs used for telephony and data, including the RJ-11, RJ-12, RJ-14, RJ-25, RJ-48, RJ-61 and RJ-45 connector. Numbering and pinouts were set forth by the Bell System as the Universal Service Order Code (or Universal Service Ordering Code) (USOC), and were introduced in the 1970s by AT&T. They are also registered with the US Federal Communications Commission (FCC), under 47 CFR §68.502. It is important to note that the USOC does not necessarily define exactly which connector is used. Unofficial designations for this often use P for positions (even if they do not have an actual pin in them), and C for conductors (that is, actual wires or pins connected).

The invention, inter alia, improves the locking, release and connectivity of all plugs including the most familiar registered jacks such as the 6-position connectors known variously as RJ-11 (2 conductor/1 pair), RJ-12 or RJ-25 (6 conductor/3 pair), and RJ-14 (4 conductor/2 pair); and the RJ-45 (8 conductor/4 pair), all sometimes simply called RJ connectors. These RJ connectors are commonly used in building wiring for telephone and local area networks. Moreover, the RJ connectors: an eight-pin RJ-45 plug, six-pin RJ-25 or RJ-12 plug, four-pin RJ-11 or RJ-14 plug, and a four-pin RJ-22 (RJ-10 or RJ-9) handset plug all may be modified according to the invention. The six-position plug and jack commonly used for telephone line connections may be called an RJ-11, RJ-14 or even RJ-12 (RJ-25), all of which properly define interfaces that use the same physical connector. The four-position RJ-11 standard typically dictates a 2-wire connection, while RJ-14 usually spells out a 4-wire configuration, and RJ-12 or RJ-25 uses all six wires. These six-position plugs are often called modular connectors to distinguish them from older telephone connectors, which were very bulky or wired directly to the wall and therefore not very modular.

As designed, the RJ type connectors are often physically compatible in that a four-pin plug will fit a six-pin or eight-pin socket, connecting to the center four of the conductors, and a six-pin plug will fit an eight-pin socket, connecting to the center six conductors. However, plugs from different manufacturers may not have this compatibility, and some manufacturers of eight-pin jacks now explicitly warn that they are not designed to accept smaller plugs without damage. Some RJ-XX jacks are also available keyed, having an extra side tab to fit in an appropriate keyed jack, to make it intentionally incompatible with standard jacks.

The RJ-11 type connector is found commonly on almost all phone and fax equipment. However, all these connectors are normally used with twisted pair wiring. Wiring conventions were designed to take full advantage of this physical compatibility. The RJ-11 connector is typically for one telephone line. The RJ-14 is typically for two telephone lines. The RJ-12 or RJ-25 is typically for three telephone lines. The RJ-45 connector is typically for Ethernet applications. There are unofficial types (having similar structure, but the wiring is not governed by regulation) of smaller connectors having four connectors such as the RJ-9, RJ-10, and RJ-22 for telephone handsets.

Figure 10:
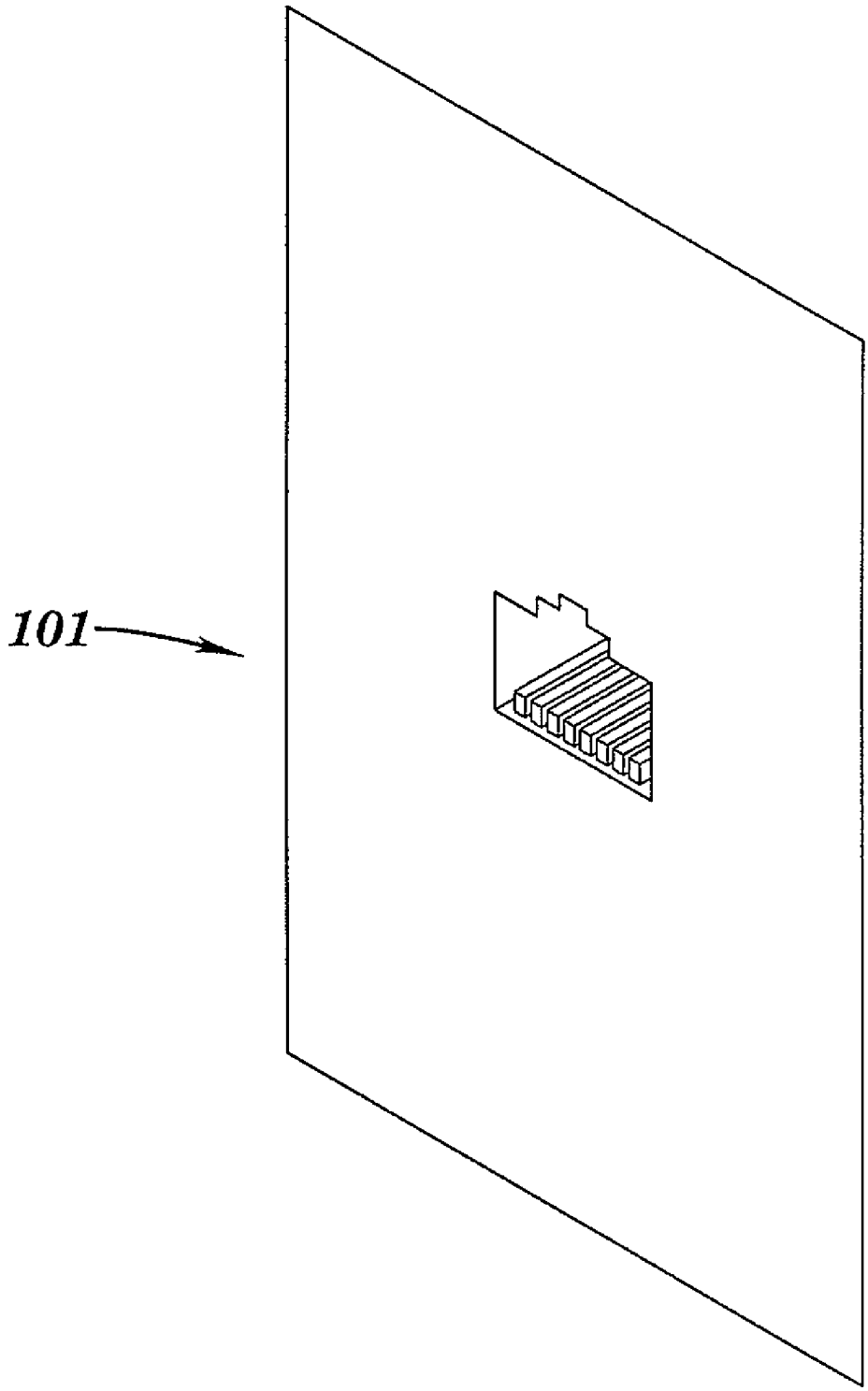
FIG. 10 displays a typical corresponding RJ-type socket.

In one embodiment a connector 100 comprising a connector body 10 having an input section 20 and an output section 30, wherein said output section 30 is dimensioned for insertion into a corresponding socket 101 as shown in FIG. 10. The connector body 10 of the connector 100 may be made of plastics or other non-conductive dimensionally stable materials. When the connector is made it may be one piece formed with the required contacts in place or it could be a multi-piece body where the contacts are introduced after a molding operation and assembled from several pieces. The connector tab 40 may be formed as an integral part of the connector body 100 or added in a secondary operation. The connector tab 40 may be made of the same or different material as the connector body or it could be a composite with a metal center or other element to increase the bias pressure against the lock 45 over a similarly dimensioned plastic part.

In FIG. 1 the body has been divided by a dashed line indicating the portion of the body 10 considered the input section 20 and the output section 30. The output section 30 fits within a corresponding socket, such as embodied socket 101, and has a general shape and profile defined by the dimensions of a corresponding socket 101 as shown in FIG. 10. The output section contains at least one electrical contact for connection to the socket 101, for example with eight being the typical number of contacts in an RJ-45 ethernet standard connector or six in an RJ-11 phone connector even if not all are wired.

The output section 30 may be dimensioned to fit within a socket 101 within a certain range of dimensions but, if the output section 30 is too small the connector 10 may either fall out or fail to make a sufficient electrical connection. Furthermore, if the output section is too large then it will not fit within the socket and thus either fail to make a connection or break the connector body 10 during forced entry or removal from the socket 101. Also connectors that are within the low end of the range of accepted tolerances may have problems with sufficient pressure on the contacts. The invention, inter alia, addresses the deficiencies by modifying either the input section 20 of the connector body 10, the output section 30 or both.

In one embodiment is a connector tab 40 having a locking device 45, said connector tab having a first end 43 and a second end 44, wherein the first end 43 is attached to and lies within the input section 20 of the connector body 10 and the second end 44 is spaced away from connector body 10, wherein said locking device 45 is positioned at the second end 44, wherein the locking device 45 is within the output section 30. The connector tab 40 may be a protrusion of any shape having an ability to stay in tension when deformed from its resting position. Moreover, the protrusion may be positioned away from the body 10 at rest with its base attached to the input section 20. Therefore, the majority of the body 41 of the connector tab 40 is outside of the socket 101 when the connector 100 is connected thus removing strict dimensional requirements. The only dimensional requirement of the protrusion or connector tab 40 is that the locking device 45, positioned on the protrusion, such as at the end or tip of the protrusion is dimensioned and positioned to fit within a lock receiver portion of a corresponding socket 101.

The design of the improved connector tab 40 may allow for positioning of the majority of a release mechanism outside of the output section 30 allowing the external section of the tab to increase in size. Accordingly, the enlarged surface area of the locking tab 40 may make gripping and removal easier. Optionally at the first end 43 may be an enlarged section that may have a pad by which the user can press against to insert or remove the connector 100 from a terminal jack 101. An enlarged tab 43 may be utilized to enhance a user's ability to grasp the connector's locking tab 40 due to its increased surface area and protrusion from the terminal jack 101. The standard locking tab on these connectors is often a small, rectangular tab that has a majority of its body inserted into a terminal jack when connected that may be very difficult to get a finger on for release from its locked position. The enlarged tab end 43 may have a fingertip sized end on it that may be at least 50% wider than the locking device 45, up to and including 100% of the width of the connector body 10. In addition, the enlarged tab end 43 may provide the user with more area to apply pressure and thus allows for easier removal from terminal jacks 101.

Referring further to FIG. 1, the cable connector 100 has a locking tab 45 that may have an enlarged end 43 with an increased surface area relative the lock 45 to provide greater ease of insertion and removal from the terminal jack 101. This additional surface area may create a more ample tab sticking out from the jack 101 when in use and thus require less precision to unlock. To remove the space constraints imposed by the corresponding socket 101 on the tab dimensions and to allow for a larger tab end 43, the majority of the tab body is positioned within the input section 20 of the connector body 10 with the lock 45 being spaced away from the connector body 10, where the lock 45 is just within the output section allowing for a locking engagement with the socket 101. To engage the connector 100 with a socket 101 requires compression of the tab 43 to decrease the distance that the lock 45 is spaced away from the body of the socket 100. Failure to compress the tab 43 during installation may prevent the output section 30 from entering the socket 101 because the locking end 45 may be spaced apart too far from the connector body 100 for entrance into socket 101. The socket 101 does not compress the locking tab 45 during connector 100 installation when the base 43 or first end is affixed to the input section 20.

The connector body 100 may be configured to be an ethernet cable as defined in the art as an RJ-45 connector having at least eight contacts or it may be a phone connector such as an RJ-11 connector having at least four contacts. When the locking tab 45 has a base or first end 43 mounted on the input section 20 it can be made to have greater tension in the lock when connected by either having a thicker tab body or having the lock 45 being spaced further away from the body 100 then possible with a connector with a base attached to the output section. When the lock 45 is spaced further away from the body 10 it may have greater stored energy when put into the locked position when in a corresponding socket 101.

The connection of the first end 43 of the tab to the input section 20 allows for greater tension between the lock 45 and the corresponding socket 101. The increase in tension of the lock 45 with the socket 101 may lead to enhanced contact pressure between the socket 101 and the contacts 160 that have a greater wiping pressure and thus better electrical connectivity. When the connector has a lock mechanism positioned on the body on a side opposite of the position of the contacts, an increase in contact pressure may occur by increasing lock pressure because of the transmission of the force through the body when in tension with the socket 101. The RJ-11 and RJ-45 type connectors have the lock 45 on the opposite side of the connector body 10 and therefore greater lock pressure may be translated into greater contact pressure.

The connector may allow for easier removal by allowing better gripping of the connector tab 40 that lies external to the corresponding socket 101. The first end 43 of connector tab 40 may lie within the input section 20 and have a textured surface 46 to enhance grip. The first end 43 of said connector tab 40 that lies within input section 20 may have a greater width then said second end 44 that lies within the output section 30. To aid in gripping, the first end 43 of connector tab 40 that lies within input section 20 may have a width or diameter 47 that is at least 50% of the width of the connector body 48.

The contact pressure to the at least one contact 150 in the output end 30 of the connector 100 may be improved by further increasing selected compression of the connector body 10. The pressure may be increased by including at least one raised pressure area 170 positioned within the output section 30 and adjacent the second end 44 of the locking tab 40, wherein said raised pressure area 170 is dimensioned to be under a compressive force when connected into the corresponding socket 101. The raised pressure area 170 may be any material having low creep properties when under compression so as to maintain a constant force. The raised pressure area 170 may be a protrusion or extension that fits within the socket when connected that maintains a state of tension on the contacts 150 by acting like a compressed spring In another embodiment is a reverse lock-tab connector 200 comprising a connector body 110 having an input end 120, an output end 130, a first side 112 and a second side 114. The connector body 110 may be made out of any rigid, non-conductive materials such as a plastic. The connector body 110 and all other associated parts of the connector may be molded in one operation such as by injection molding the connector body 110 around the contacts 150 or the connector body could be multiple parts that are assembled together.

Figure 2:
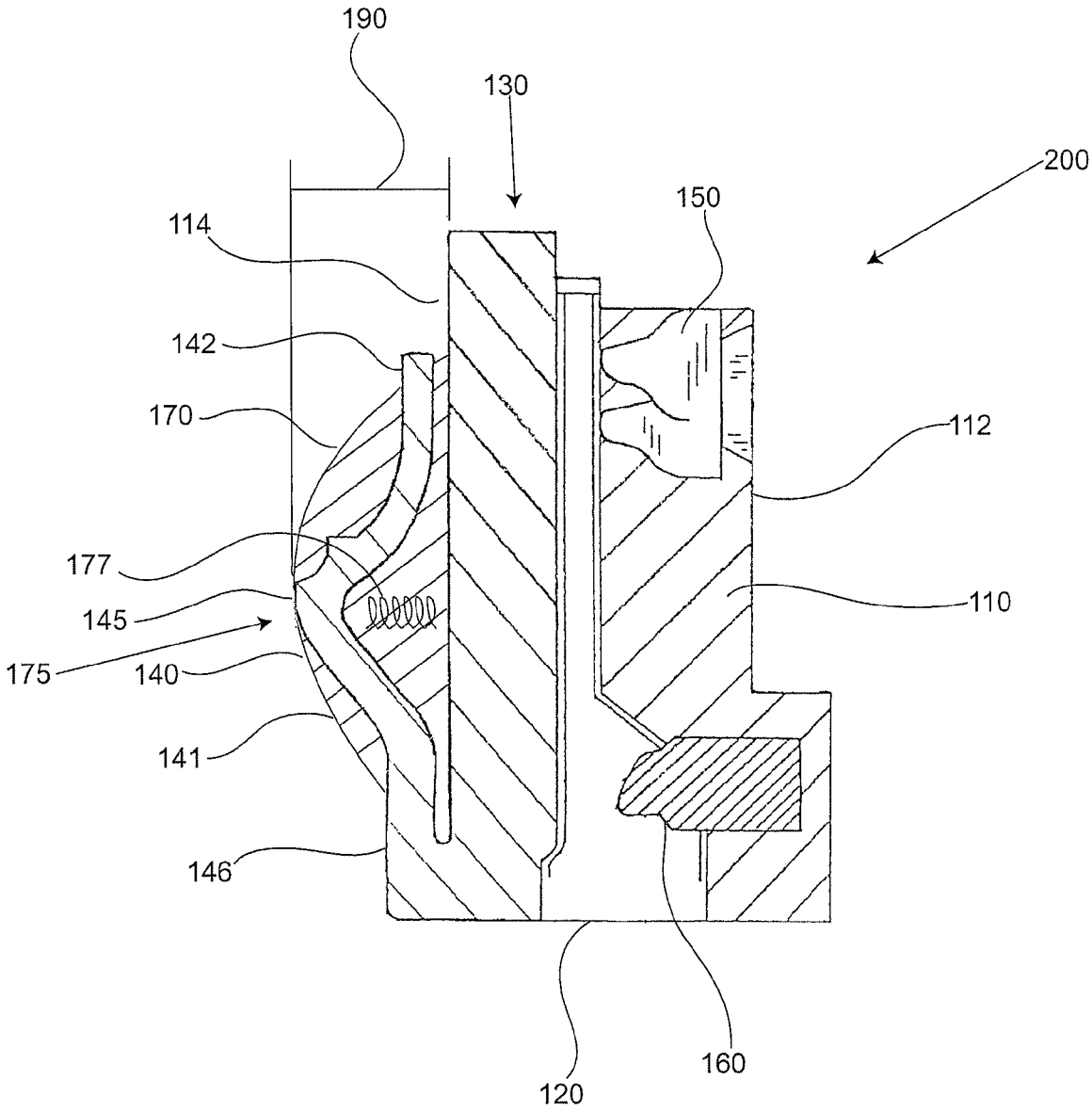
FIG. 2 displays a side view of one embodiment of the connector.

On, or attached to, the connector body 110 may be a connector tab 140 having a base end 146 and a lock end 142, wherein the base end 146 is attached to the input end 120 of the connector body 110 and wherein the lock end 142 is spaced away from connector body 110. In FIG. 2 a cutaway view of the connector body 200 is shown where the dashed line indicates a possible demarcation of the connector into the input end 120 and the output end 130.

The connecter 200 has a reverse tab 140 because the base end 146 is mounted to the input side 120 of the connector 200, which may allow the user to apply pressure in a more efficient manner to release the connector from a jack 101. The reverse tab 140 may create a larger surface area that may aid in creating a better fit within the terminal jack 101. The reverse tab 140 may create a larger area for a user to grasp when removing the connector from a terminal jack 101. Additionally, this reverse tab's end 142 may aid in creating a tighter, more secure fit within the terminal jack 101, as it is also entered into the jack 101 when the connector 200 is inserted. When the reverse tab 140 is compressed by the user, the pressure is released on the locking part 145 of the tab 140 and the connector can be easily removed.

Figure 5:
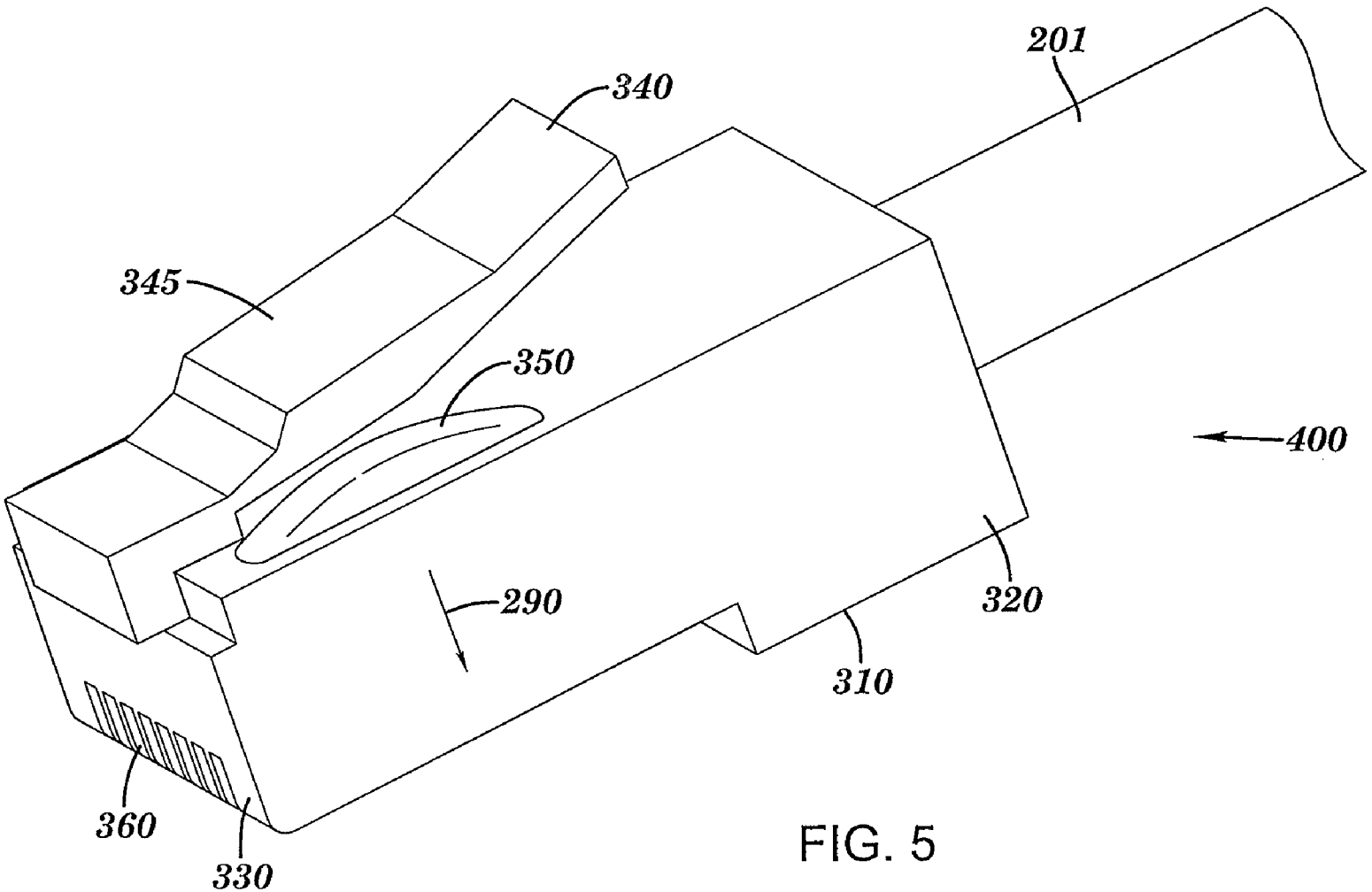
FIG. 5 displays a perspective view of an improved embodiment of an RJ-45 connector and a wire.
Figure 6:
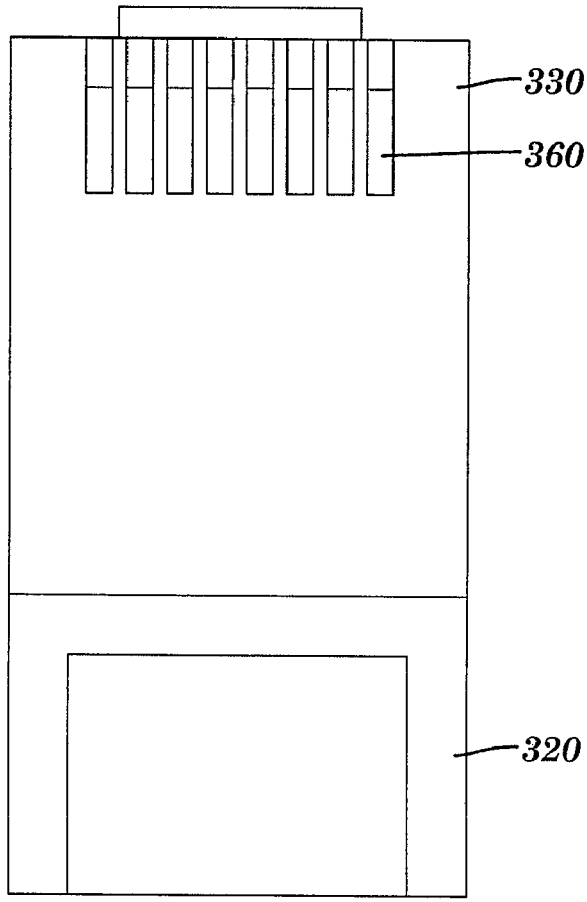
FIG. 6 displays top view of an improved embodiment of an RJ-45 connector.
Figure 7:
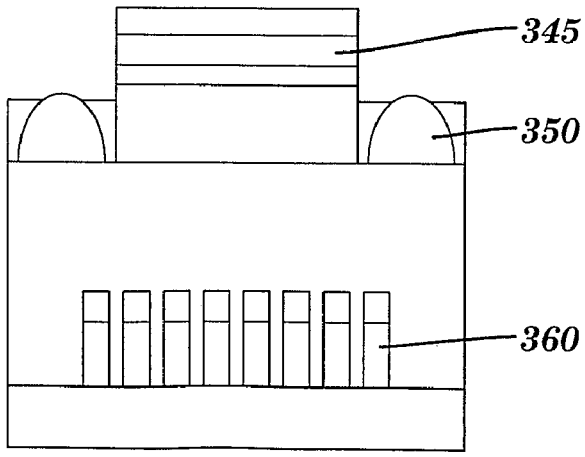
FIG. 7 displays a front view of an improved embodiment of an RJ-45 connector.
Figure 8:
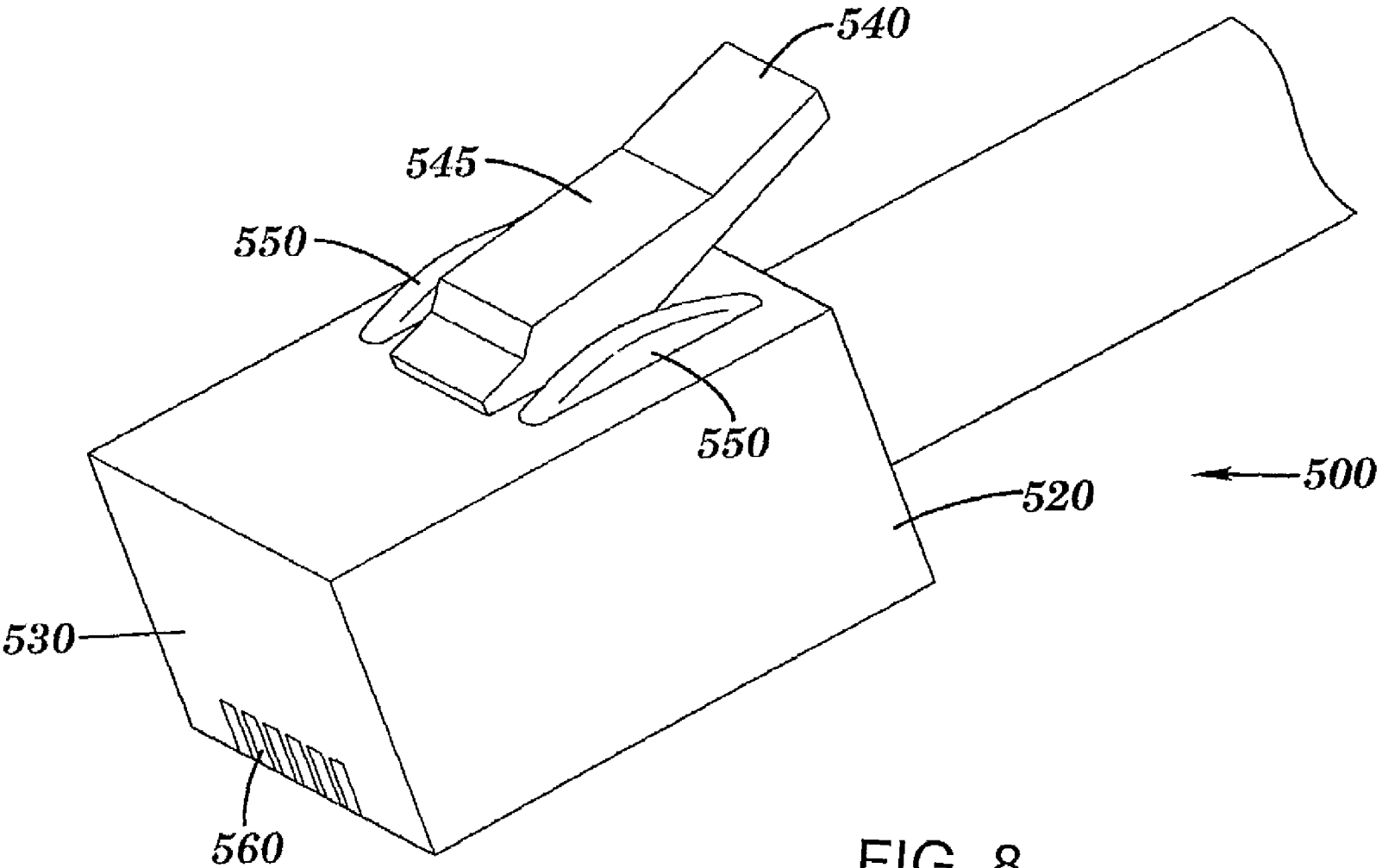
FIG. 8 displays a top perspective view of an improved embodiment of an RJ-11 connector.
Figure 9:
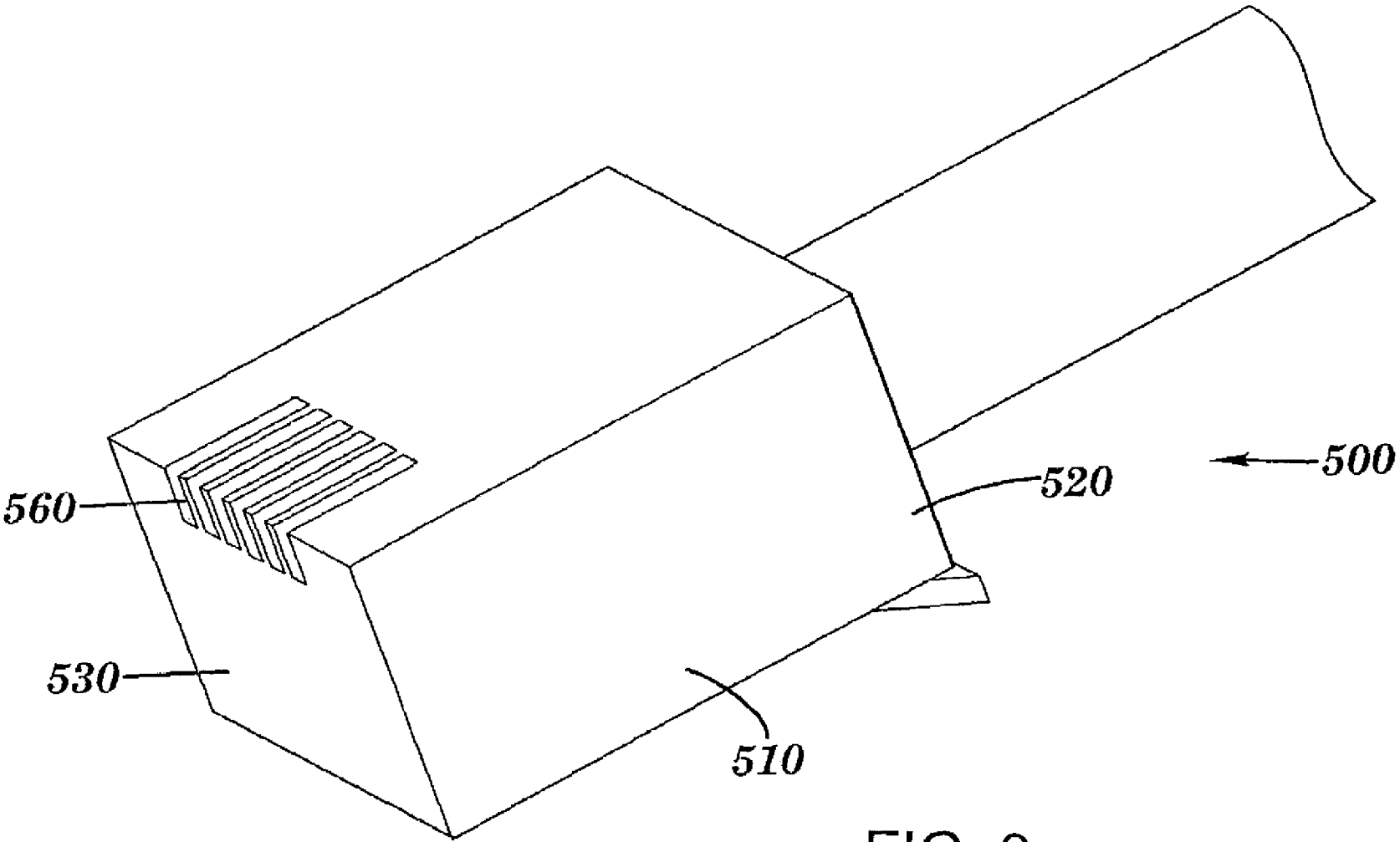
FIG. 9 displays a bottom perspective view of an improved embodiment of an RJ-11 connector.

As illustrated in FIG. 2, the cable connector 200 is shown from a side view, with a reverse tab assembly 140, wherein the tab assembly is oriented opposite how either the common RJ-45 or RJ-11 jacks' locking tabs are mounted. This reverse tab 140, when compressed, can aid in creating a tighter fit within the terminal jack 101 and is easier to engage because the surface area 141 to apply pressure to, for removal, may be enlarged quite substantially. The connector 200 may also be configured so that the output end 130 of the connector body 110 is dimensioned to be an RJ-45 connector and having at least eight contacts 150 arranged linearly as shown in FIGS 5-7. The connector 200 may be configured so that the output end 130 of the connector body 110 is dimensioned to be an RJ-11 connector and having at least four contacts 150 arranged linearly. The contacts 150 may either be insulation displacement contacts when in modular connector for assembly onto a wire or just regular contacts when the connector is already mounted on a wire or cable 201 such as in a molded or connector assembly.

The connector 200 comprises at least one contact 150 in the output end 130 of the first side 112 of the connector body 110. An optional feature of the reverse tab 140 connector 200 may be the addition of at least one raised pressure area 170 having a peak 175, said raised pressure area 170 positioned on the second side 112 of the output end 130 of the connector body 110, wherein said peak 175 of said raised pressure area 170 is adjacent to the locking tab 145.

Figure 3:
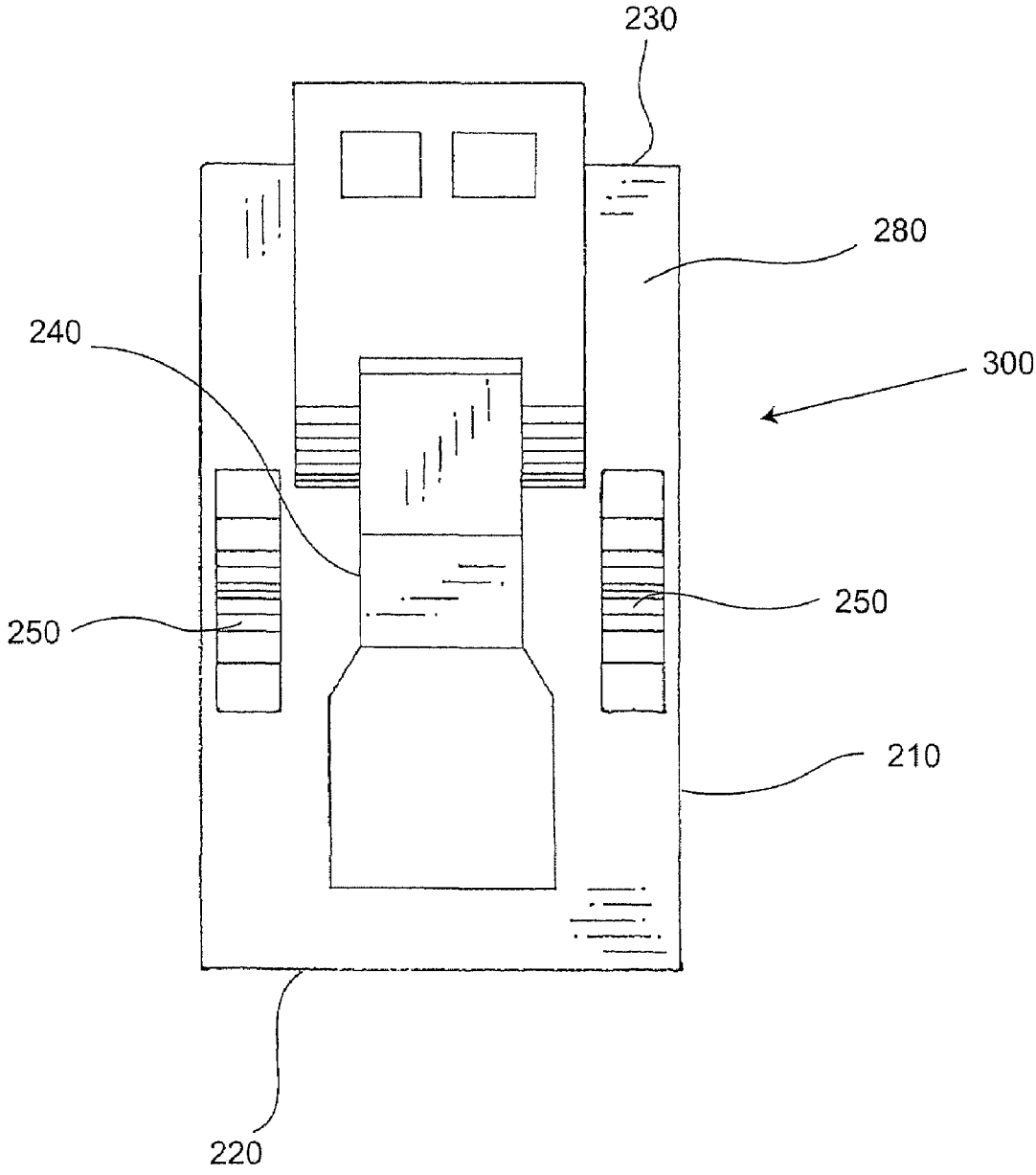
FIG. 3 displays a top view of one embodiment of the connector.

Another embodiment displayed in FIG. 3 is an enhanced contact pressure connector 300 that comprises a connector body 210 having an output section 230 and an input section 220. Attached to the connector 300 is a locking tab 240 having a lock 245, said tab 240 positioned on said connector body 210. When the connector 300 is made it may be one piece formed with the required contacts 260 in place or it could be a multi-piece body 210 where the contacts are introduced after an injection molding operation and assembled from several pieces. The connector tab 240 may be formed as an integral part of the connector body 300 or added in a secondary operation. The connector tab 240 may be made of the same or different material as the connector body 210 or it could be a composite with a metal center or other element to increase the bias pressure against the lock 245 over a similarly dimensioned plastic part.

In FIG. 3 the body 210 has been labeled with a dashed line indicating a portion of the body 210 considered the input section 220 and an output section 230. The output section 230 may fit within a corresponding socket 101 and has a general shape and profile defined and bound by the dimensions of a corresponding socket 101. The output section 230 contains at least one electrical contact 260 for connection to the socket 101, for example with eight being the required number of contacts in an RJ-45 ethernet standard connector or four in an RJ-11 phone connector.

As shown in FIG. 3 the connector 300 has a connector body 210 having an output section 230, an input section 220 and at least two sides 280, 285, wherein the sides 280, 285 are opposite each other. The connector 300 has at least one contact 260 positioned on the connector body 210 in the output section 230 on one side 285. The connector 300 has at least one raised pressure area 250, wherein said raised pressure area 250 is positioned to be within the output section 230 of the connector body 210 on the other side 280, wherein when said raised pressure area 250 directs force 290 to the at least one contact 260 when compressed.

The connector 300 has at least one raised pressure area 250 that may be adjacent to a lock 245 on the locking tab 240, wherein said raised pressure area 250 is positioned to be within the output section 230 of the connector body 210. The ramps 250 on the connector body 210 are used to increase the pressure on the at least one contact 260, so as to provide more downward and inward force, creating a better and more consistent connection between the contacts 260 such as an Insulation Displacement Contacts (IDC s) and the terminal jack connector 101. The ramps 250 may be employed to maintain continuous pressure on the surface area of at least one contact 260 to create a more secure tight fit within terminal jack 101. Ramps 250 may be located along each side of the locking tab on the RJ-45 connector specifically designed to have a maximum height 255, whereby this peak 255 may coincide with the locking tab 240 to create a larger surface area of pressure within the terminal jack 101. As the connector 300 is being inserted into the terminal jack 101, the connector may achieve an increasingly tighter fit until it reaches a maximum height 255 and the locking tab 240 clicks the connector 300 securely in the jack 101, while at least one ramp 250 maintains that maximum pressure inside the jack 101. This additional pressure may ensure a better and more consistent connection between the terminal contacts 260 on the connector 300 and inside the terminal jack 101, creating more downward and inward force simultaneously.

FIG. 3 shows a top view of the cable connector 300 with ramps 250 on each side of the locking tab 240 that may allow continuous pressure on the surface area of this locking tab 140. The ramps 250 depict the peak elevation 255 to be substantially identical to that of the locking tab 245 when fully inserted in the terminal jack 101, thus providing for a better connection with the terminal contacts 260.

Figure 4:
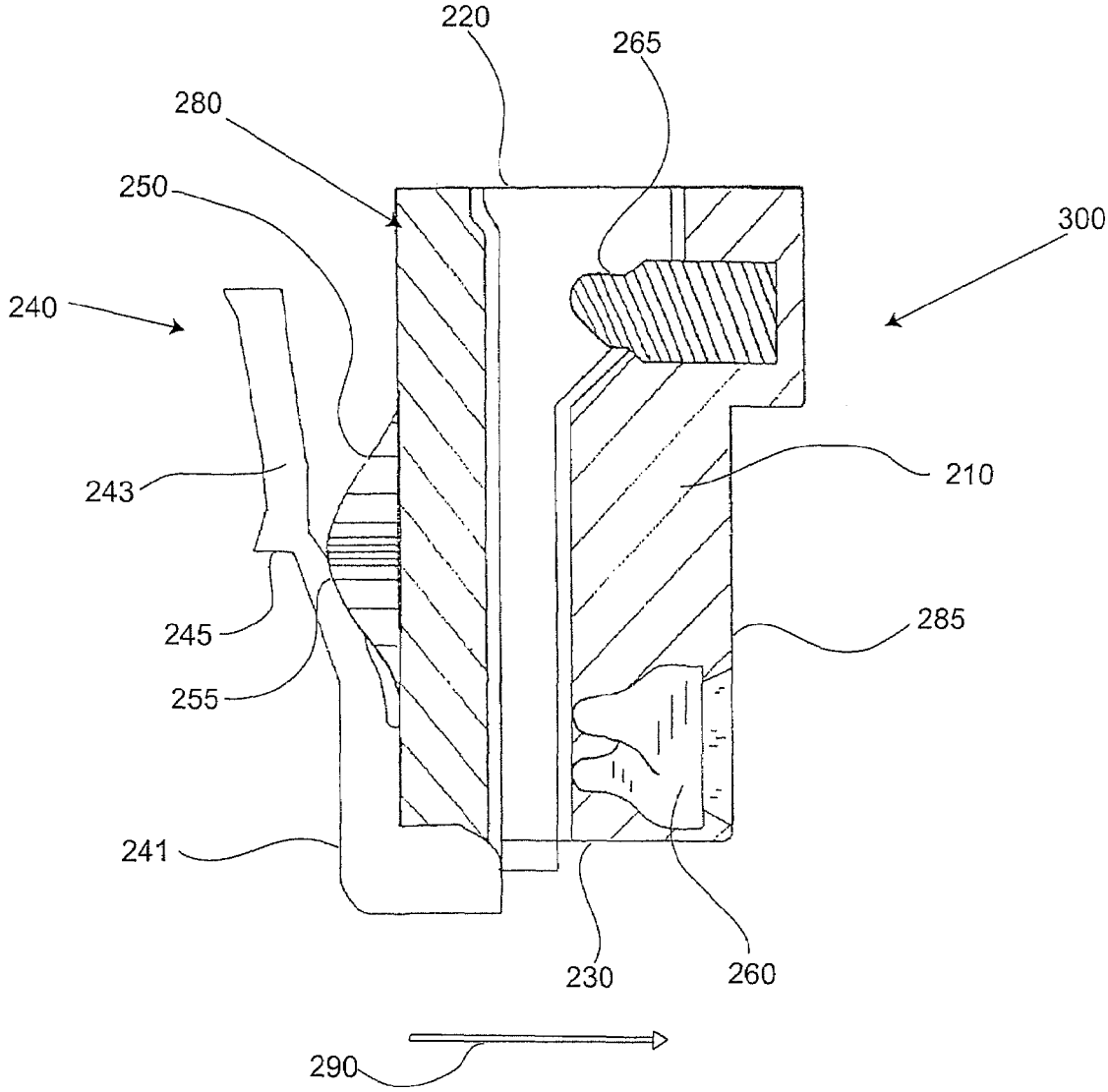
FIG. 4 displays a side view of one embodiment of the connector.

FIG. 4 shows a side view of the cable connector 300 with ramps 250 on each side of the locking tab 240 which may allow for continuous pressure on the surface area of the locking tab 240. Again, the ramps 250 depict the peak elevation 255 to be almost identical to that of the locking tab 240 when fully inserted in the terminal jack 101, thus the connector 300 may provide for a better contact with the terminal contacts 260. Moreover, the connector 300 may be configured so that a base portion 241 of the locking tab 240 may be affixed to the connector body 210 beyond the raised pressure portion 250. The connector 300 may contain at least one strain relief cable crimp 265 disposed with the connector body 210.

The connector 300 has at least one contact 260, which may be an insulation displacement contact 260, disposed within the connector body 210. The design is not limited in the amount or type of contacts and shape that the connector body 210 may have as long as it corresponds to a socket 201. The connector body 210 may be dimensioned to be received by a socket for an RJ-11, RJ-45 plug or any other plug that has a tab lock 240 on one side and terminals 260 on the opposite side from the tab lock. The raised pressure features 250 are useful on any connector with terminals if they can be positioned on an opposite side of the connector body from the contacts so that the contact faces are pressed against the corresponding socket contacts 202.

The connector 300, when dimensioned to fit into either an RJ-11 or RJ-45, may include a raised pressure area 250 that may either be a single or a pair of ramp shaped protrusions 250 on each side of the locking tab 240. When the connector 300 is an RJ-45 connector there are typically at least eight contacts 260, such as insulation displacement contacts 260, disposed within the output section 230 of the connector body 210, wherein the contacts 260 may be disposed linearly. The connector 300 that includes a locking tab 240 and the raised pressure area 250 may have a peak 255, wherein said peak 255 of said pressure area 250 is adjacent to the lock 245 on the locking tab 245 on the connector 210. The connector 300 may be configured to have a raised pressure area 250 where the height 190 of the peak 175 is at least the same height 190 from the connector body 210 as the lock 145 of the locking tab 140 (as shown in FIG. 2).

The connector 300 may include either a biasing element 243 within the locking tab 240 adjacent the raised pressure area 250 as shown in FIG. 4 or a pressure area biasing element 177 within the raised pressure area 170 as shown in FIG. 2.

Another embodiment is a connector for improved contact tension within a corresponding socket, said connector comprising a connector body 10, 110, 210 having at least one contact 60, 160, 260. The connector 100, 200, 300 may include a means of locking the connector within the corresponding socket 101, said means of locking positioned on said connector body 10, 110, 210. The means of locking can be a clasp, snap, clip, bolt, compression fit or any other above described method of locking the connector within a corresponding socket 101. The connector 100, 200, 300 may include at least one means of increasing pressure to the at least one contact 60, 160, 260 when the connector body 10, 110, 210 is inserted into the corresponding socket 101. The means of increasing pressure on at least one contact may be a ramp, a bump, a protrusion, any other raised surface area or a biasing element such as a spring. The spring may be coiled, linear, disc like or any shaped element that deforms and then recovers its initial shape with minimal loss of energy usually spring steel in a variety of configurations. The biasing element may be present in either the means for locking or the means of increasing pressure elements. The means of increasing pressure can be made of the same or different material than that of the connector.

As illustrated in FIGS. 5-9, cable connectors 400, 500 is shown from a side view, with input ends 320, 520 and output ends 330, 530 and a tab assembly 340, 540 similar to how the normal RJ-45 or RJ-11 jacks' locking tabs are mounted. The tab 340, 540 acts similar when compressed. However, the addition of at least one raised pressure area 350, 550 can aid in creating a tighter fit within the terminal jack 101. The connector 400 may be configured so that the output end 330 of the connector body 110 is dimensioned to be an RJ-45 connector and having at least eight contacts 150 arranged linearly as shown in FIGS 5-7. Whereas FIG. 8-9, the connector 500 may be configured so that the output end 530 of the connector body 510 is dimensioned to be an RJ-11 connector and having at least four contacts 150 arranged linearly, usually 6 contacts are provided even if normally four are only used. The RJ-11 may be wired to act as an Ethernet connector. The contacts 360, 560 may be insulation displacement contacts 360, 560 when in a modular connector for assembly onto a wire or just regular contacts 360, 560 when the connector is already mounted on a wire or cable 201 such as in a molded on connector assembly.

The connectors 400, 500 may also have the addition of at least one raised pressure area 350, 550 having a peak 355, 555, said raised pressure area 355, 555 positioned on the second side 312, 512 of the output end 330, 530 of the connector body 310, 510 wherein said peak 355, 555 of said raised pressure area 350, 550 is adjacent to the locking tab 345, 545. The connector tab 340, 540 may be made of the same or different material as the connector body 310, 510 or it could be a composite with a metal center or other element to increase the bias pressure against the lock 345, 545 over a similarly dimensioned plastic part.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims. The claims provide the scope of the coverage of the invention and should not be limited to the specific examples provided herein.

We claim:

1. A registered jack connector comprising:

a registered jack connector body having an input section and an output section, wherein the output section is dimensioned for insertion into a corresponding registered jack socket;

a connector tab having a locking device, the connector tab having a first end and a second end, wherein the first end is attached to and lies within the input section of the connector body and the second end is entirely spaced away from connector body, wherein the locking device is positioned at the second end, and is within the output section, wherein the first end of said connector tab that lies within the input section has a greater width than the second end of the connector tab that lies within the output section; and, at least one raised pressure area on the connector body, the raised pressure area being a ramped shaped protrusion having a central peak elevation, wherein the raised pressure area contacts and is compressed by the socket when the connector is inserted into the socket.

2. The connector of claim 1 wherein the output section of the connector body is configured to be an RJ-45 connector having at least eight contacts.

3. The connector of claim 1 wherein the first end of connector tab that lies within the input section and has a textured surface to enhance grip.

4. The connector of claim 1, wherein the first end of connector tab that lies within input section has a diameter that is greater than 50% of a width of the connector body.

5. The connector of claim 1 wherein the connector tab is formed as an integral part of the connector body.

6. The connector of claim 1 further comprising:

at least one contact in the output end of the connector body.

7. A reverse lock-tab registered jack connector comprising:

a registered jack connector body having an input end, an output end, a first side and a second side;

a connector tab having a base end and a lock end, wherein the base end is attached to the input end of the connector body and wherein the lock end is entirely spaced away from connector body, and wherein the base end of the connector tab has a greater width than the lock end of the connector tab; and, at least one raised pressure area on the connector body, the raised pressure area including a ramped shaped protrusion having a central peak elevation, wherein the raised pressure area contacts and is compressed by a corresponding registered jack socket when the connector is inserted into the socket.

8. The connector of claim 7 wherein the output end of the connector body is dimensioned to be an RJ-45 connector and having at least eight contacts arranged linearly.

9. The connector of claim 7 further comprising:

at least one contact in the output end of the first side of the connector body; and, wherein the at least one raised pressure area is positioned on the second side of the output end of the connector body, wherein a peak of said raised pressure area is adjacent to the locking tab.

10. A registered jack connector for improved contact tension within a corresponding registered jack socket, the connector comprising:

a registered jack connector body having at least one contact;

a locking tab for locking the connector within the corresponding registered jack socket, the means of locking positioned on said connector body;

at least one ramped means of increasing pressure to the at least one contact when the connector body is inserted into the corresponding socket, wherein the at least one ramped means of increasing pressure includes a central peak elevation and is located along the sides of the locking tab, and further wherein the at least one means of increasing pressure contacts and is compressed by the registered jack socket when the connector is inserted into the socket.

* * * * *